US007048408B2

(12) United States Patent
Dallas et al.

(10) Patent No.: US 7,048,408 B2
(45) Date of Patent: May 23, 2006

(54) LIGHTING HEAD MECHANISM AND FILTER

(75) Inventors: Edgar A. Dallas, Beaverton, OR (US); Frederick T. Karl, West Linn, OR (US)

(73) Assignee: Fiskars Brands, Inc., Madison, WI (US)

( * ) Notice: Subject to any disclaimer, the term of this patent is extended or adjusted under 35 U.S.C. 154(b) by 0 days.

(21) Appl. No.: 10/903,449

(22) Filed: Jul. 30, 2004

(65) Prior Publication Data

US 2006/0023444 A1 Feb. 2, 2006

(51) Int. Cl.
*F21L 4/00* (2006.01)

(52) U.S. Cl. ..... 362/202; 362/208; 362/293

(58) Field of Classification Search ..... 362/202, 362/208, 259, 280, 293, 319, 321, 800
See application file for complete search history.

(56) References Cited

U.S. PATENT DOCUMENTS 1,241,771 A * 10/1917 Schram ..... 362/202
1,443,106 A * 1/1923 Walsh ..... 362/202
2,296,005 A * 9/1942 Weiner ..... 362/202
2,347,531 A 4/1944 Yardeny
2,389,591 A 11/1945 Brown
3,936,147 A 2/1976 Murakami
3,936,164 A 2/1976 Cohen et al.
4,202,601 A 5/1980 Burbo et al.
4,346,329 A 8/1982 Schmidt
4,517,628 A 5/1985 McDermott
4,580,196 A 4/1986 Task
4,677,533 A 6/1987 McDermott et al.
4,697,890 A 10/1987 Crookston
4,947,291 A 8/1990 McDermott
4,963,798 A 10/1990 McDermott
5,037,346 A 8/1991 Cimock
5,161,879 A 11/1992 McDermott
5,581,356 A 12/1996 Vezard
5,617,080 A 4/1997 Morich
RE36,197 E 4/1999 Walker
5,896,189 A * 4/1999 Watkins ..... 355/71
6,061,591 A 5/2000 Freitag et al.
RE37,136 E 4/2001 Vezard

* cited by examiner

*Primary Examiner*—Y. My Quach-Lee
(74) *Attorney, Agent, or Firm*—Foley & Lardner LLP

(57) ABSTRACT

A flashlight includes a body with a head, the head having a central axis. A light source is coupled to the body and a lens assembly is rotatably coupled to the head. The lens assembly has a rotational axis and a plurality of filters offset from the rotational axis such that rotation of the lens assembly places different filters on the output side of the light source. The rotational axis of the lens assembly is substantially aligned with the central axis of the head.

13 Claims, 3 Drawing Sheets

LIGHTING HEAD MECHANISM AND FILTER

FIELD OF THE INVENTION

The present invention relates to a light with colored lenses. In particular, the present invention relates to an improved system for providing mechanically selectable colored lenses for a light.

BACKGROUND OF THE INVENTION

The need for color filtered light is common among hunters, stargazers, and military and security personnel engaged in covert operations. Color filtered light is preferable to white light in that it helps preserve the night vision of the user and nearby individuals. Additionally, filtered light may be more difficult to detect by observers, particularly hostile observers equipped with modem image-intensifiers.

One challenge to providing a system for color filtering a light source is to make the filter mechanism simple to operate. If there are multiple or complex control inputs, a user may accidentally turn on a white light source at a high setting and thus negatively impact the user's night vision with a flash of bright light, or give away the user's location to a hostile observer.

Another challenge to providing a system for color filtering a light source is to enable the user to select the operating mode of the light by tactile sensation only, under conditions of total darkness. In some circumstances, the user may be unwilling to turn the light on until the light is properly set, thus ensuring that detection or loss of night vision does not occur.

One way of providing color filters for a light is to provide translucent lenses in various colors that the user may insert in place of a transparent bulb cover, as disclosed in U.S. Pat. No. 4,697,890 to Crookston. However, a disadvantage of this approach is that changing the filter color of the light requires disassembly and reassembly. This may be difficult to accomplish in the dark, and may be a slow, time-consuming process. Also, disassembly increases the chances of dropping and possibly losing critical parts during the exchange process. Additionally, the use of separate filters presents the disadvantage of having loose parts, which require storage when not in use. Loose parts are also more vulnerable to loss during periods of disuse than filters that are an integral part of the light.

Another approach to providing a variable color light source is to use independent lamps or bulbs, each of a different color or with a separate color filter. However, the use of multiple bulbs increases the number of component parts and raises the cost of manufacturing such a flashlight. Furthermore, the control of multiple light sources may require either more user inputs or more complex electronic switching to take advantage of the separate bulbs. Additional switches or more complex controls may also increase the risk of user error, which could negatively impact the operator's night vision or increase the chance of detection. Additional controls may also raise the cost of manufacturing, and possibly make the device more prone to failure.

Yet another approach to providing a variable color light source is to use a single lamp or bulb, and a wheel fitted with a variety of colored filters, as disclosed in U.S. Pat. No. 3,936,164 to Cohen et al. However, the light disclosed therein is bulky and awkward, in part due to the significant difference in diameter between the flashlight body and the attached color wheel. Further, the rotational axis of the color wheel is parallel to, but offset from, the longitudinal axis of the flashlight body. As a result, the color wheel extends to one side of the flashlight, producing a lopsided and awkward instrument.

Accordingly, there is a need for a color filtered light that is both simple to operate and quickly changeable by the user, even under conditions of total darkness. Further, there is a need for a color filtered light that is reliable, convenient to use, and contains a small number of inexpensive components.

It would be desirable to provide a system and/or method that provides one or more of these or other advantageous features. Other features and advantages will be made apparent from the present specification. The teachings disclosed extend to those embodiments that fall within the scope of the appended claims, regardless of whether they accomplish one or more of the aforementioned needs.

SUMMARY OF THE INVENTION

The invention relates to a flashlight having a body with a head, the head having a central axis. A light source is coupled to the body and a lens assembly is rotatably coupled to the head. The lens assembly has a rotational axis and a plurality of filters offset from the rotational axis such that rotation of the lens assembly places different filters in front of the light source. The rotational axis of the lens assembly is substantially aligned with the central axis of the head.

The invention further relates to a flashlight having a body with a head, and a light source coupled to the head. A lens assembly is rotatably coupled to the head, the lens assembly including a plurality of filters. An indexing mechanism is coupled to the head and engages the lens assembly to snap the lens assembly into a selected rotational position.

The invention further relates to a flashlight having a body with a head, and a light source coupled to the body. A lens assembly is rotatably coupled to the head, the lens assembly including a plurality of filters. The flashlight further includes an alignment mechanism set in the head and set in the lens assembly providing tactile information regarding a position of the lens assembly.

The invention is capable of other embodiments and of being practiced or carried out in various ways. Alternative exemplary embodiments relate to other features and combinations of features and may be generally recited in the claims.

DETAILED DESCRIPTION

Figure 1:
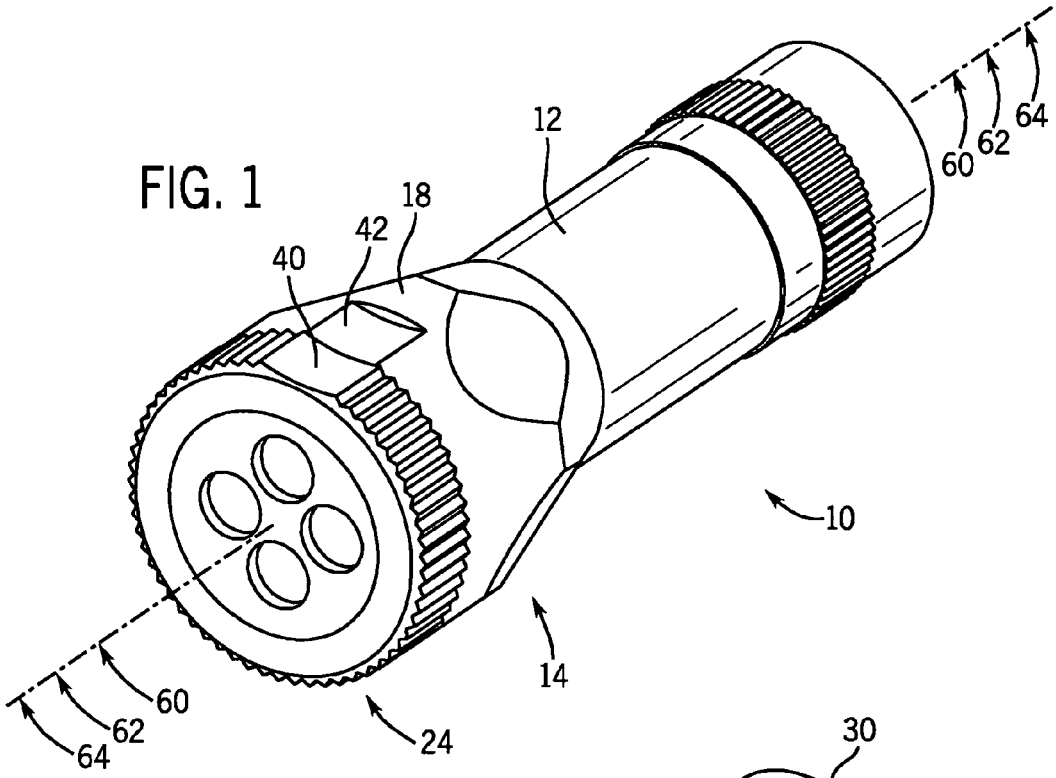
FIG. 1 is a perspective view of a light equipped with a rotatable lighting head mechanism.

Referring to FIG. 1, according to an exemplary embodiment of the present invention, a light, shown as a flashlight 10, includes a body 12 and a lighting head mechanism 14. The body 12 may be cylindrical or another shape, and may be made of metal, plastic, or other materials. The body 12 may contain batteries or another power source. The body 12 may contain additional internal wiring or a switch, which may be embodied in a variety of types and configurations as is generally known in the art.

Further referring to FIG. 1, the lighting head mechanism 14 includes a head shell 18 and a rotatable lens assembly 24. In a preferred embodiment, the head shell 18 is fixed in rotational position relative to the body 12. The lens assembly 24 is capable of unlimited free rotation in either direction relative to the head shell 18. However, in an alternative embodiment, the lens assembly 24 may be fixed relative to the flashlight body 12, and the head shell 18 capable of free rotation with respect to both the flashlight body 12 and the lens assembly 24.

In an exemplary embodiment, body 12 is cylindrical and has a longitudinal axis 60, and the head shell 18 has a central axis 62 in alignment with the longitudinal axis 60. The lens assembly 24 is positioned so that it has a rotational axis 64 aligned with the longitudinal axis 60 of the body 12 and the central axis 62. In embodiments where the body 12 is of a different shape or orientation, the longitudinal axis 60 may not align with the rotational axis 64, or the body 12 may not have a readily ascertainable longitudinal axis. However, the rotational axis 64 will generally be substantially aligned with the central axis 62 of head shell 18.

The head shell 18 and lens assembly 24 may be provided with an alignment mechanism, shown as alignment flats 40 and 42. The user may align flats 40 and 42 to rotate the lens assembly 24 to a known position with respect to the head shell 18 using tactile or visual senses. In alternative embodiments, the alignment flats 40 and 42 may be replaced with a raised edge, raised dots, grooves, or depressions that similarly provide the user with a tactile or a visual indicator of the rotational position of the lens assembly 24.

Figure 2:
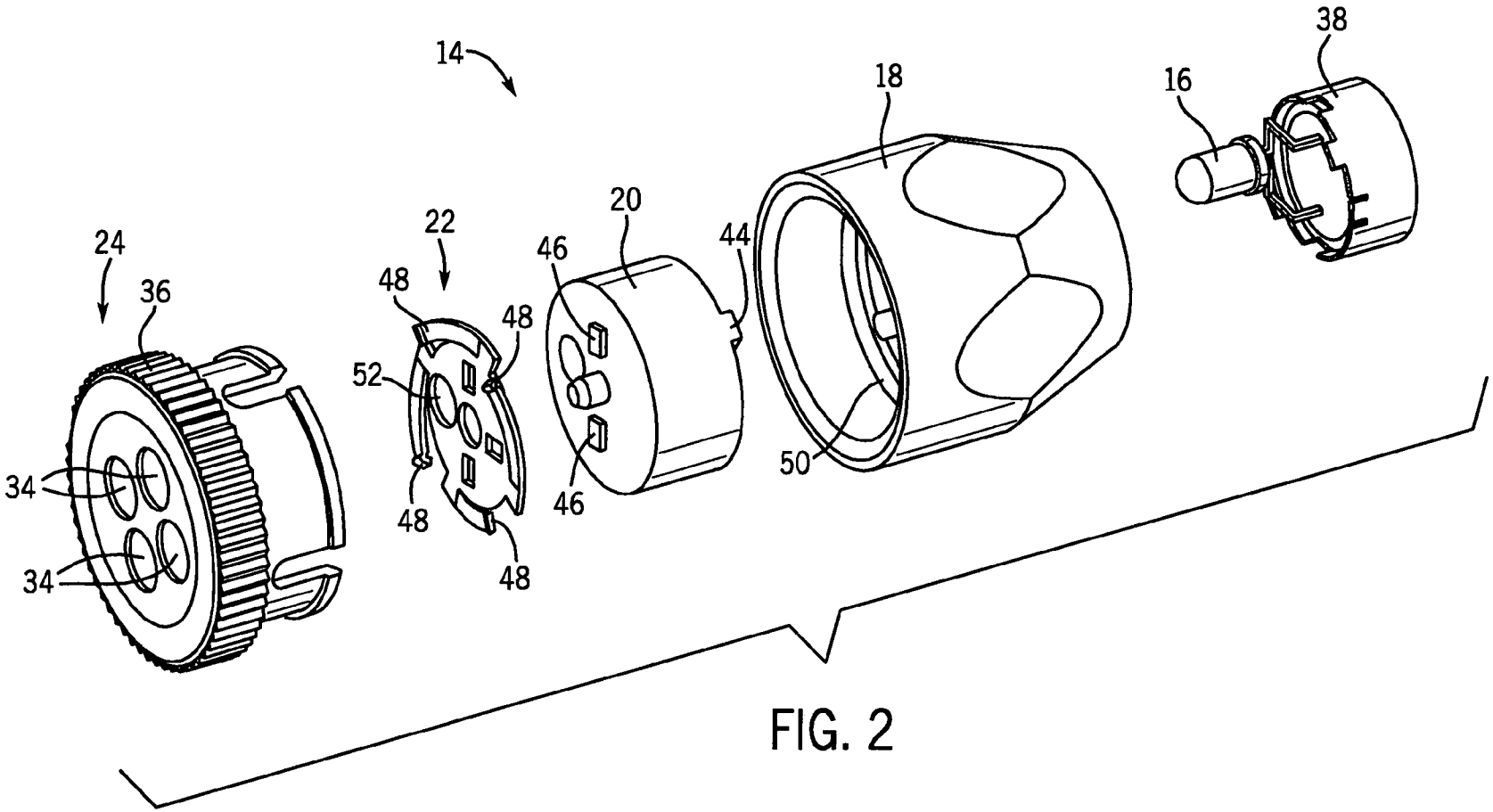
FIG. 2 is an exploded perspective view of a rotatable lighting head mechanism.

Referring to FIG. 2, according to an exemplary embodiment, the lighting head mechanism 14 includes a light source 16, a head shell 18, a light source housing 20, a light mount 38, an indexing mechanism, shown as detent mechanism 22, and a rotatable lens assembly 24. The light source 16 is offset from the rotational axis 64 (see FIG. 1) of the lens assembly 24, such that rotation of the lens assembly 24 will present one of a number of filters/lenses 34 to the light source. In a preferred embodiment, light source 16 is a light emitting diode (LED). In alternative embodiments, the light source 16 may be a conventional bulb, such as an incandescent, halogen or krypton bulb, or any other source of light.

The light source housing 20 is sized to fit within the head shell 18. In the embodiment depicted in FIG. 2, the light source housing 20 fits snugly within the head shell 18, and is rotationally fixed with respect to the head shell 18 by a tab 44 that engages a corresponding slot in the head shell 18. The light source housing 20 surrounds the light source 16, and prevents light leakage to ensure that light emanating from the light source 16 will be constrained to passing through only one filter/lens 34 (see also FIGS. 3 and 4). In addition, the light source housing 20 is shown with locking tabs 46 to engage corresponding recesses in the detent mechanism 22 to maintain the detent mechanism 22 rotationally fixed with respect to the light source housing 20. In alternative embodiments, The detent mechanism 22 may instead be formed as one integral piece with the light source housing 20, or secured to the housing 20 by an adhesive or fastener. The light source housing 20 may further incorporate a reflector, appropriate to the type of bulb or light source used, as is generally known in the art.

Further referring to FIG. 2, the light source 16 is secured to light mount 38. In an exemplary embodiment, the light source 16 is an LED, affixed to the light mount 38. If other bulb types are used, the light source 16 may be connected to the light mount 38 by a threaded connection, a bayonet connection, or other connection types as are known to the art. The light mount 38 may further contain mounting posts, electronic controls, battery terminals, switches, or any method of support or control of the light source 16.

Further referring to FIG. 2 a passageway 52 in the detent mechanism 22 provides an unobstructed path from the light source 16 to the filters/lenses 34. A set of spring arms 48 of the detent mechanism 22 engage the rotatable lens assembly 24. The detent mechanism 22 provides tactile feedback to the user and allows the user to quickly and accurately place the lens assembly 24 in proper alignment with light source 16. In combination with the alignment flats 40 and 42, the detent mechanism 22 allows selection of a proper filter in all operating conditions, including complete darkness, prior to activation of the light.

Referring to FIGS. 1 and 2, the rotatable lens assembly 24 is secured to the head shell 18 in a manner that allows free rotation about the central axis 62 of the head shell 18. As shown, a filter ring 36 provides a one-way snap engagement with a recessed channel 50 located in the inner circumference of the head shell 18. The filter ring 36 is also provided with a knurled edge, allowing the user to easily rotate the lens assembly 24.

Figure 3:
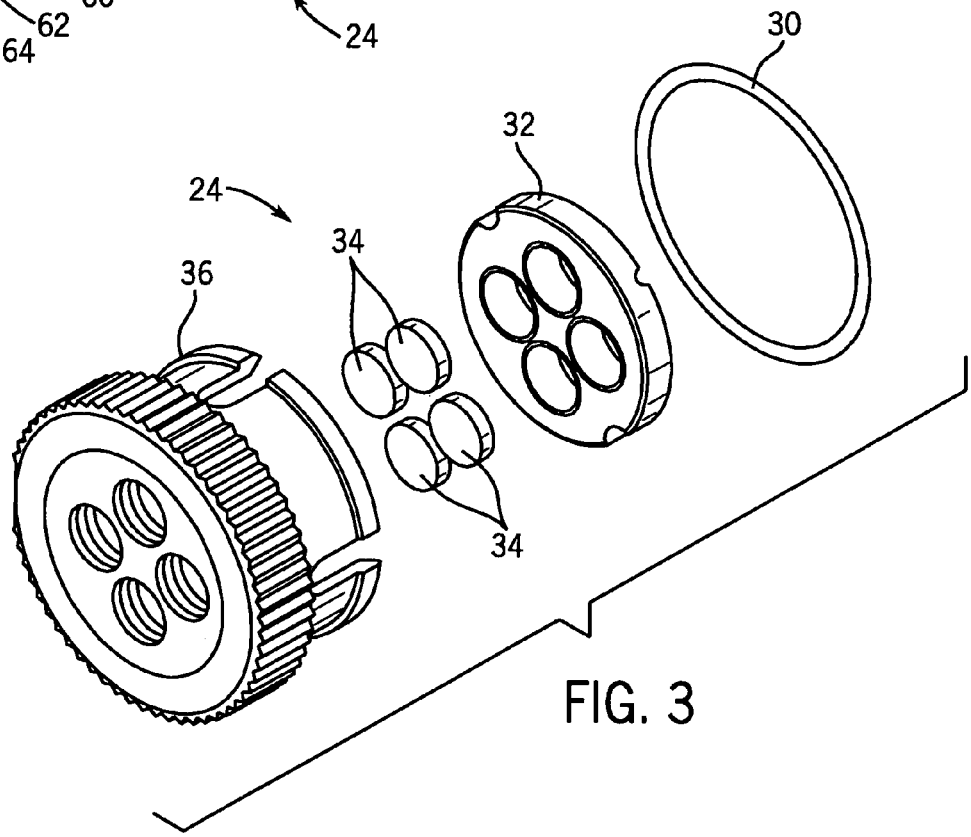
FIG. 3 is an exploded perspective view of a rotatable lens assembly.
Figure 4:
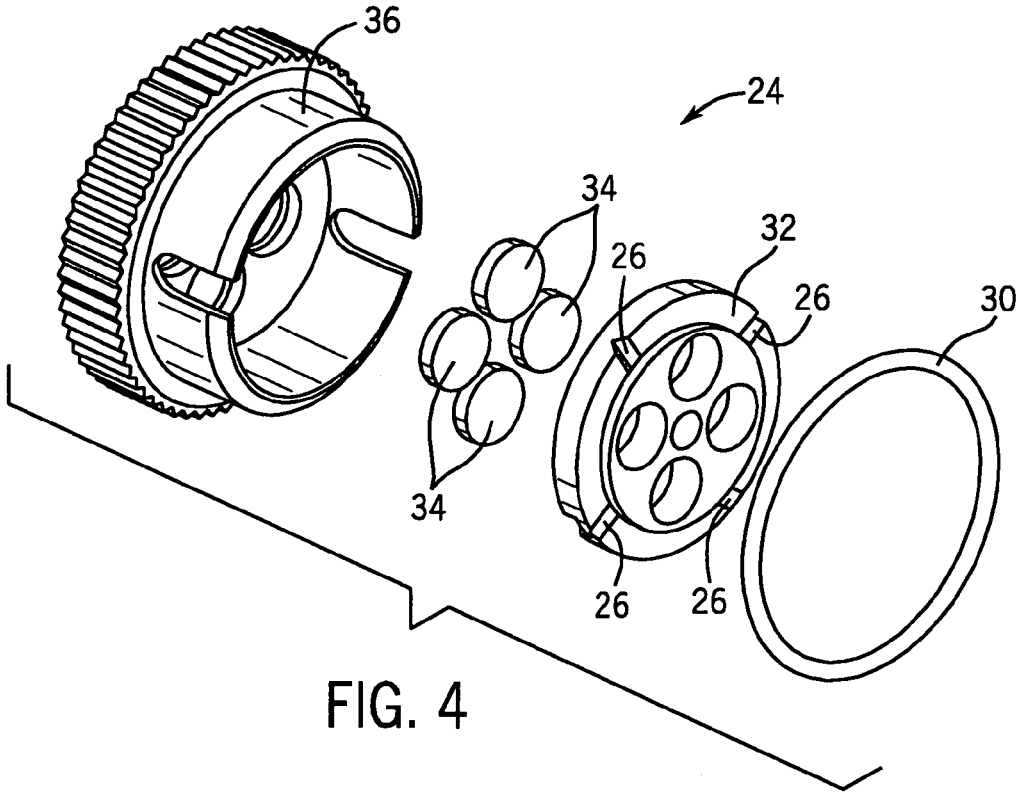
FIG. 4 is an exploded perspective view of the rotatable lens assembly of FIG. 3 from a different direction.

Referring to FIGS. 3 and 4, the rotatable lens assembly 24 further includes a gasket 30, a filter plate 32, a number of filters/lenses 34, and the filter ring 36. The filter plate 32 has a number of notches 26. The individual filters/lenses 34 are set into the filter ring 36, and held in place by the filter plate 32. The notches 26 of the filter plate 32 are engaged by the spring arms 48 (See FIG. 2) of the detent mechanism 22 to provide indexed rotation of the lens assembly 24. In an exemplary embodiment, the gasket 30 provides a seal between the filter ring 36 and the head shell 18.

Further referring to FIGS. 3 and 4, the filters/lenses 34 may be clear, or various colors, or polarized. Additionally, the filters/lenses 34 may be configured to selectively transmit various non-visible ultraviolet or infrared wavelengths of light. In an exemplary embodiment, the filters/lenses 34 are blue, green, red, and clear. The number and type of the filters/lenses 34 may be varied with the size of the lighting head mechanism 14, the power of the light source 16, and the needs of the user.

Figure 5:
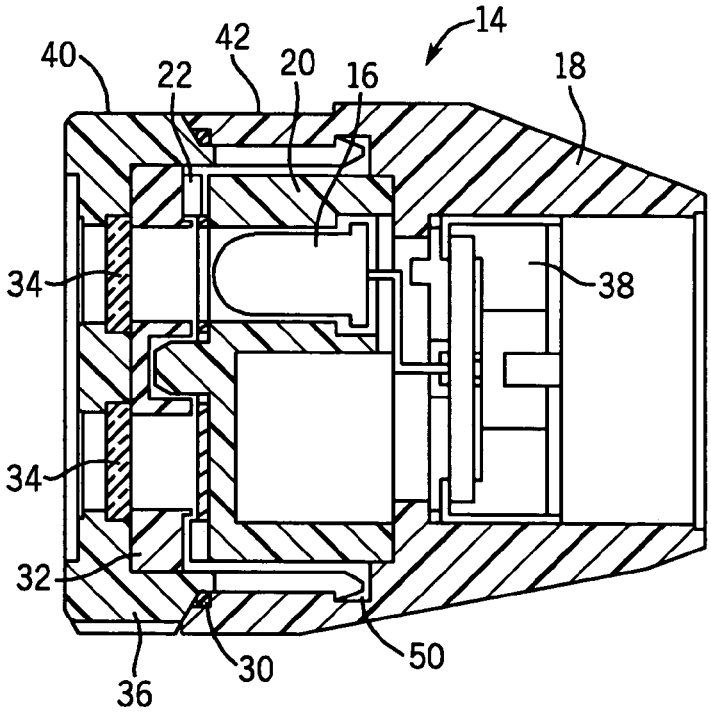
FIG. 5 is a sectional view of a rotatable lighting head mechanism.

Referring to FIG. 5, the lighting head mechanism 14 is shown according to an exemplary embodiment. The head shell 18 may be provided with a threaded connection to couple the head shell 18 to the body 12. In alternative embodiments, the body 12 and head shell 18 may be a single contiguous piece, secured with adhesive, snapped into position, or otherwise secured. The light source 16 is presented with a single filter/lens 34, while the light source housing 20 prevents light leakage to other filters/lenses. As shown, the alignment flats 40 and 42 are aligned.

In operation, a user may readily switch the flashlight 10 between available color filter positions by grasping the body 12 or head shell 18, and applying a rotational torque to the rotatable lens assembly 24. The user may detect a positive tactile feedback as the spring arms 48 of the detent mechanism 22 engage the notches 26 of the filter plate 32, ensuring that the chosen filter/lens 34 will be placed in proper position to allow an unobstructed pathway from light source 16 to the environment. The user may further employ the alignment flats 40 and 42 to place the rotatable lens assembly 24 in a known position relative to the head shell 18 prior to activation of the light source 16. As this procedure does not necessarily rely on any visual cues, the user may perform color selection even in conditions of total darkness. Once the rotatable lens assembly is in a known position, other filters/lenses 34 may be selected by rotation of the lens assembly 24 a predetermined number of steps to the right or left, as indicated by tactile feedback from the detent mechanism. Additional tactile cues may be provided on the lens assembly 24 or the head shell 18 to further specify the precise rotational position of the lens assembly 24 during operation.

According to an exemplary embodiment, the present invention provides an improved method for switching a single light source between a variety of colors, in a form that is easy and convenient to use. The present invention avoids the use of spare or loose parts, and allows the user to operate the invention solely by tactile feedback, thus allowing operation in conditions of total darkness. By aligning the rotational axes of the lens assembly and the head, the present invention also provides a balanced light without a lopsided appearance or feel. The present invention also uses avoids the use of more complex electronic controls to vary the color output, thus improving reliability and durability.

While the detailed drawings and specific examples given herein describe various exemplary embodiments, they serve the purpose of illustration only. It is to be understood that the invention is not limited in its application to the details of construction and the arrangements of components set forth in the preceding description or illustrated in the drawings. For example, the particular detent mechanism and head configuration is but one way of attaching indexing a rotatable lens assembly. Furthermore, other substitutions, modifications, changes, and omissions may be made in the design, operating conditions, and arrangements of the exemplary embodiments without departing from the scope of the invention as expressed in the appended claims.

What is claimed is:

1. A flashlight, comprising:

a body having a head, the head having a central axis;

a light source coupled to the body;

a lens assembly rotatably coupled to the head, the lens assembly having a rotational axis and a plurality of filters offset from the rotational axis, wherein rotation of the lens assembly places different filters of the plurality of filters on an output side of the light source, wherein the rotational axis of the lens assembly is substantially aligned with the central axis of the head; and an alignment mechanism providing tactile information regarding the rotational position of the lens assembly.

2. The apparatus of claim 1, wherein the flashlight further comprises an indexing mechanism coupled to the head and engaging the lens assembly to snap the lens assembly into a selected rotational position.

3. The apparatus of claim 2, wherein the indexing mechanism comprises a detent mechanism.

4. The apparatus of claim 1, wherein the alignment mechanism comprises:

a first alignment flat on the rotatable lens assembly; and a second alignment flat on the head positioned to contact the first alignment flat when the lens assembly is in a known rotational position.

5. The apparatus of claim 1, wherein the light source is a light emitting diode.

6. The apparatus of claim 1, wherein each of the plurality of filters allows different wavelengths of light to pass.

7. The apparatus of claim 1, wherein the lens assembly has four filters.

8. A flashlight, comprising:

a body having a head;

a light source coupled to the head;

a lens assembly rotatably coupled to the head, the lens assembly including a plurality of filters;

an indexing mechanism coupled to the head and engaging the lens assembly to snap the lens assembly into a selected rotational position; and an alignment mechanism providing tactile information regarding the position of the lens assembly.

9. The apparatus of claim 8, wherein the indexing mechanism comprises a detent mechanism.

10. The apparatus of claim 8, wherein the alignment mechanism comprises:

a first alignment flat on the lens assembly; and a second alignment flat on the head positioned to contact the first alignment flat when the rotatable lens assembly is in a known rotational position.

11. The apparatus of claim 8, wherein the light source is a light emitting diode.

12. The apparatus of claim 8, wherein each of the plurality of filters allows different wavelengths of light to pass.

13. The apparatus of claim 8, wherein the lens assembly has four filters.

* * * * *